US010056219B2

(12) United States Patent
Duncan et al.

(10) Patent No.: US 10,056,219 B2
(45) **Date of Patent: *Aug. 21, 2018**

(54) APPLICATIONS OF GRAPHENE GRIDS IN VACUUM ELECTRONICS

(71) Applicant: ELWHA LLC, Bellevue, WA (US)

(72) Inventors: William David Duncan, Mill Creek, WA (US); Roderick A. Hyde, Redmond, WA (US); Jordin T. Kare, San Jose, CA (US); Max N. Mankin, Cambridge, MA (US); Tony S. Pan, Bellevue, WA (US); Lowell L. Wood, Bellevue, WA (US)

(73) Assignee: Elwha LLC, Bellevue, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/603,340

(22) Filed: May 23, 2017

(65) Prior Publication Data

US 2017/0323755 A1 Nov. 9, 2017

Related U.S. Application Data

(63) Continuation of application No. 14/706,485, filed on May 7, 2015, now Pat. No. 9,659,735, which is a continuation-in-part of application No. 14/613,459, filed on Feb. 4, 2015, now Pat. No. 9,659,734, and a (Continued)

(51) Int. Cl.

| | |
|---|---|
| ***H01J 1/48*** | (2006.01) |
| ***H01J 3/02*** | (2006.01) |

(52) U.S. Cl.

CPC ..... *H01J 1/48* (2013.01); *H01J 3/021* (2013.01); *H01J 2203/0232* (2013.01); *Y10T 29/49204* (2015.01)

(58) Field of Classification Search

CPC ..... H01J 25/00; H01J 1/46; H01J 1/48

See application file for complete search history.

(56) References Cited

U.S. PATENT DOCUMENTS

| | | | |
|---|---|---|---|
| 2,404,919 | A | 7/1946 | Overbeck |
| 2,489,850 | A | 11/1949 | Baker |
| 2,744,960 | A | 5/1956 | Greefkes et al. |

(Continued)

FOREIGN PATENT DOCUMENTS

| | | | |
|---|---|---|---|
| CN | 102339699 | A | 2/2012 |
| CN | 102339699 | A | 2/2012 |

(Continued)

OTHER PUBLICATIONS

The State Intellectual Property Office of P.R.C., Second Office Action, App. No. 2012/80065581.6 (Based on PCT Patent Application No. PCT/US2012/071833); dated Jul. 22, 2016; pp. 1-9 (machine translation, as provided).

(Continued)

*Primary Examiner* — Anne Hines

(57) ABSTRACT

Graphene grids are configured for applications in vacuum electronic devices. A multilayer graphene grid is configured as a filter for electrons in a specific energy range, in a field emission device or other vacuum electronic device. A graphene grid can be deformable responsive to an input to vary electric fields proximate to the grid. A mesh can be configured to support a graphene grid.

34 Claims, 13 Drawing Sheets

Related U.S. Application Data continuation-in-part of application No. 13/612,129, filed on Sep. 12, 2012, now Pat. No. 9,646,798.

(60) Provisional application No. 61/993,947, filed on May 15, 2014.

(56) References Cited

U.S. PATENT DOCUMENTS

| | | | |
|---|---|---|---|
| 2,798,963 | A | 7/1957 | Saget |
| 4,274,035 | A | 6/1981 | Fukuhara et al. |
| 4,427,886 | A | 1/1984 | Martin et al. |
| 4,721,885 | A | 1/1988 | Brodie |
| 5,177,402 | A | 1/1993 | Howard et al. |
| 5,272,411 | A | 12/1993 | Francisco et al. |
| 5,371,371 | A | 12/1994 | Yamazaki et al. |
| 5,386,172 | A | 1/1995 | Komatsu |
| 5,548,138 | A | 8/1996 | Tanimoto et al. |
| 5,578,901 | A | 11/1996 | Blanchet-Fincher et al. |
| 5,606,215 | A | 2/1997 | Jaskie et al. |
| 5,631,524 | A | 5/1997 | Matsuzaki et al. |
| 5,717,279 | A | 2/1998 | Imura |
| 5,834,781 | A | 11/1998 | Fukuhara |
| 5,838,096 | A | 11/1998 | Shinada et al. |
| 5,850,120 | A | 12/1998 | Okamoto |
| 5,908,699 | A | 6/1999 | Kim |
| 5,936,348 | A | 8/1999 | Shimoi et al. |
| 5,936,354 | A | 8/1999 | Smith et al. |
| 5,942,834 | A | 8/1999 | Davis |
| 5,982,095 | A | 11/1999 | Jin et al. |
| 6,031,336 | A | 2/2000 | Rumbaugh et al. |
| 6,104,143 | A | 8/2000 | Bonavia |
| 6,205,790 | B1 | 3/2001 | Denkin et al. |
| 6,249,080 | B1 | 6/2001 | Komoda et al. |
| 6,313,587 | B1 | 11/2001 | MacLennan et al. |
| 6,373,175 | B1 | 4/2002 | Cade et al. |
| 6,404,089 | B1 | 6/2002 | Tomion |
| 6,538,367 | B1 | 3/2003 | Choi et al. |
| 6,590,320 | B1 | 7/2003 | Abanshin et al. |
| 6,632,113 | B1 | 10/2003 | Noma et al. |
| 6,949,887 | B2 | 9/2005 | Kirkpatrick et al. |
| 7,061,188 | B1 | 6/2006 | Katyl et al. |
| 7,157,849 | B2 | 1/2007 | Seon et al. |
| 7,462,979 | B2 | 12/2008 | Konishi et al. |
| 7,710,013 | B2 | 5/2010 | Tatsumi et al. |
| 7,741,764 | B1 | 6/2010 | Sung |
| 7,750,462 | B1 | 7/2010 | Cohn et al. |
| 7,825,591 | B2 | 11/2010 | Kimiya et al. |
| 7,903,789 | B2 | 3/2011 | Morton et al. |
| 8,018,169 | B2 | 9/2011 | Jeong et al. |
| 2002/0036452 | A1 | 3/2002 | Muroyama et al. |
| 2003/0001490 | A1 | 1/2003 | Yamamoto et al. |
| 2003/0006684 | A1 | 1/2003 | Kawate et al. |
| 2003/0124944 | A1 | 7/2003 | Kyogaku et al. |
| 2003/0132393 | A1 | 7/2003 | Dimitrijevic et al. |
| 2004/0004588 | A1 | 1/2004 | Kawase et al. |
| 2004/0036402 | A1 | 2/2004 | Keesmann et al. |
| 2004/0050415 | A1 | 3/2004 | Kucherov et al. |
| 2004/0118347 | A1 | 6/2004 | Groves et al. |
| 2004/0131858 | A1* | 7/2004 | Burden ..... B82Y 10/00 428/408 |
| 2004/0226914 | A1 | 11/2004 | Dong et al. |
| 2004/0238809 | A1 | 12/2004 | Adamec et al. |
| 2005/0001598 | A1 | 1/2005 | Belokon et al. |
| 2005/0016575 | A1 | 1/2005 | Kumar et al. |
| 2005/0057168 | A1 | 3/2005 | Song et al. |
| 2005/0151461 | A1 | 7/2005 | Tuck et al. |
| 2006/0139207 | A1 | 6/2006 | Nikonov |
| 2006/0261724 | A1 | 11/2006 | DiCarlo |
| 2006/0273301 | A1 | 12/2006 | Moddel et al. |
| 2006/0284539 | A1 | 12/2006 | Sung |
| 2007/0023621 | A1 | 2/2007 | Blick et al. |
| 2007/0046163 | A1 | 3/2007 | Sata et al. |
| 2007/0158588 | A1 | 7/2007 | Zhou et al. |
| 2008/0001513 | A1 | 1/2008 | Chen et al. |
| 2008/0017237 | A1 | 1/2008 | Bray et al. |
| 2008/0100235 | A1 | 5/2008 | Lin et al. |
| 2009/0011706 | A1 | 1/2009 | Wilson et al. |
| 2009/0146583 | A1 | 6/2009 | Bhadri et al. |
| 2009/0194870 | A1 | 8/2009 | Nathanson et al. |
| 2009/0303654 | A1 | 12/2009 | Fan et al. |
| 2010/0019648 | A1 | 1/2010 | Yasuda et al. |
| 2010/0026160 | A1 | 2/2010 | Terui et al. |
| 2010/0066245 | A1 | 3/2010 | Van Spijker |
| 2010/0090579 | A1 | 4/2010 | Sellmair |
| 2010/0090601 | A1* | 4/2010 | Eisen ..... H01J 1/46 315/5 |
| 2010/0102325 | A1 | 4/2010 | Kim et al. |
| 2010/0108882 | A1 | 5/2010 | Zewail |
| 2010/0271003 | A1 | 10/2010 | Jensen et al. |
| 2010/0283436 | A1 | 11/2010 | Chung et al. |
| 2010/0295486 | A1 | 11/2010 | Ikehashi |
| 2010/0329964 | A1 | 12/2010 | Roos |
| 2011/0037400 | A1 | 2/2011 | Kim et al. |
| 2011/0088954 | A1 | 4/2011 | DiGiovanni et al. |
| 2011/0147761 | A1 | 6/2011 | Yu et al. |
| 2011/0186805 | A1 | 8/2011 | Bowers et al. |
| 2011/0192976 | A1 | 8/2011 | Own et al. |
| 2011/0201201 | A1 | 8/2011 | Arnold et al. |
| 2011/0226960 | A1 | 9/2011 | Zhang et al. |
| 2012/0006784 | A1 | 1/2012 | Lin et al. |
| 2012/0041370 | A1 | 2/2012 | Moberg et al. |
| 2013/0168635 | A1 | 7/2013 | Cheatham, III et al. |

FOREIGN PATENT DOCUMENTS

| | | |
|---|---|---|
| EP | 1 063 197 A2 | 12/2000 |
| JP | 2005539401 | 12/2005 |
| WO | WO2013101937 | 7/2013 |

OTHER PUBLICATIONS

Chinese State Intellectual Property Office; Decision of Final Rejection, App No. 2012/80065581.6 (Based on PCT Patent Application No. PCT/US2012/071833); dated Dec. 21, 2015; pp. 1-6 (machine translation provided, 6 pages total).

PCT International Search Report; International App. No. PCT/US2015/030749; dated Aug. 27, 2015; pp. 1-4.

European Patent Office, Supplementary European Search Report, Pursuant to Rule 62 EPC; App. No. EP12861564; dated Jul. 23, 2015; pp. 1-6.

Bell et al.; "Precision Cutting and Patterning of Graphene with Helium Ions"; uploaded on Jul. 27, 2015; pp. 1-16.

Bieri et al.; "Porous graphenes: two-dimensional polymer synthesis with atomic precision"; Chemical Communications; Dec. 7, 2009; pp. 6919-6921; No. 45; The Royal Society of Chemistry.

Boukhvalov et al.; "Chemical functionalization of graphene"; Journal of Physics: Condensed Matter; Jul. 27, 2009; pp. 1-12; vol. 21; IOP Publishing Ltd.

Feenstra et al.; "Low-energy Electron Reflectivity from Graphene"; uploaded on Jul. 27, 2015; pp. 1-16.

Garaj et al.; "Graphene as a sub-nanometer trans-electrode membrane"; Nature Sep. 9, 2010; pp. 1-13; vol. 467; No. 7312; National Institutes of Health.

Guo et al.; "Graphene Doping: A Review"; Insciences Journal, Nanotechnology; Apr. 27, 2011; pp. 80-89; vol. 1, No. 2; Insciences Journal.

Kim et al.; "Fabrication and Characterization of Large-Area, Semiconducting Nanoperforated Graphene Materials"; NANO Letters; Mar. 1, 2010; pp. 1125-1131; vol. 10; American Chemical Society.

McClain et al.; "First-principles theory of low-energy electron diffraction and quantum interference in few-layer graphene"; Materials Science Condensed Matter; Nov. 12, 2013; pp. 1-5; arXiv.org.

Mutus et al.; "Low Energy Electron Point Projection Microscopy of Suspended Graphene, the Ultimate 'Microscope Slide'"; Mesoscale and Nanoscale Physics Condensed Matter; Feb. 17, 2011; pp. 1-16, arXiv.org.

Yan et al.; "Time-Domain Simulation of Electron Diffraction in Crystals"; Dec. 8, 2011; pp. 1-25.

(56) References Cited

OTHER PUBLICATIONS

Britnell et al.; "Electron Tunneling Through Ultrathin Boron Nitride Crystalline Barriers"; NANO Letters; bearing dates of Jan. 18, 2012, Feb. 14, 2012 and Mar. 1, 2012; pp. 1707-1710; vol. 12; American Chemical Society.
Brodie et al. "Vacuum Microelectronic Devices"; Proceedings of the IEEE; Jul. 1994; pp. 1006-1034; vol. 82, No. 7; IEEE.
Choi et al.; "A Simple Structure and Fabrication of Carbon-Nanotube Field Emission Display"; Applied Surface Science; bearing dates of Mar. 24, 2003 and Jul. 20, 2003; pp. 370-374; vol. 221; Elsevier B.V.
Chou et al.; "Sub-10 nm Imprint Lithography and Applications"; J. Vac. Sci. Technol. B; Nov./Dec. 1997; pp. 2897-2904; vol. 15, No. 6; American Vacuum Society.
Chung et al.; "Energy Exchange Processes in Electron Emission at High Fields and Temperatures"; J. Vac. Sci. Technol. B; Mar./Apr. 1994; pp. 727-736; vol. 12, No. 2; American Vacuum Society.
Dean et al.; "Current Saturation Mechanisms in Carbon Nanotube Field Emitters"; Applied Physics Letters; Jan. 17, 2000; pp. 375-377; vol. 76; No. 3; American Institute of Physics.
Desplat et al.; "Interaction of Cesium and Oxygen on W(110)"; Surface Science; 1980 (and bearing dates of Jun. 18, 1979 and Sep. 14, 1979); pp. 97-118; vol. 92; North-Holland Publishing Company.
Ding, Meng; "Field Emission from Silicon"; Paper submitted to the Department of Physics at Massachusetts Institute of Technology; Jun. 2001; 277 pp. total; Massachusetts Institute of Technology.
Fisher et al.; "Thermal and Electrical Energy Transport and Conversion in Nanoscale Electron Field Emission Processes"; Transactions of the ASME; Oct. 2002; pp. 954-962; vol. 124; ASME.
Fursey, George N.; Field Emission in Vacuum Microelectronics (1st Edition); Jan. 21, 2005; 205 pages; ISBN-10: 0306474506 and ISBN-13: 978-0306474507; Springer (entire book cited, but not provided).
Han et al.; "Vacuum Nanoelectronics: Back to the Future?—Gate Insulated Nanoscale Vacuum Channel Transistor"; Applied Physics Letters; bearing dates of Feb. 24, 2012, Apr. 22, 2012 and May 23, 2012; pp. 213505-1-213505-4; vol. 100; American Institute of Physics.
Himpsel et al.; "Quantum Photoyield of Diamond(111)—A Stable Negative-Affinity Emitter"; Physical Review B; Jul. 15, 1979; pp. 624-627; vol. 20; No. 2; The American Physical Society.
Hishinuma et al.; "Refrigeration by Combined Tunneling and Thermionic Emission in Vacuum: Use of Nanometer Scale Design"; Applied Physics Letters; Apr. 23, 2001; cover page and pp. 2572-2574; vol. 78; No. 17; American Institute of Physics.
Hu, Chenming; "Gate Oxide Scaling Limits and Projection"; International Electron Devices Meeting 1996, IEEE, pp. 319-322.
Humphrey et al.; "Power Optimization in Thermionic Devices"; J. Phys. D: Appl. Phys.; bearing dates of Nov. 11, 2004, Jun. 3, 2005 and 2005; pp. 2051-2054; vol. 38; IOP Publishing Ltd.
Humphrey et al.; "Reversible Quantum Brownian Heat Engines for Electrons"; Physical Review Letters; Sep. 9, 2002; pp. 116801-1-116801-4; vol. 89, No. 11; The American Physical Society.
Japanese Patent Office; Notice of Rejection; App. No. 2009-500523; Mar. 21, 2013; 6 total pages (3 pages with English Machine Translation).
Kusunoki et al.; "Highly Efficient and Long Life Metal-Insulator-Metal Cathodes"; J. Vac. Sci. Technol. B—Microelectronics and Nanometer Structures; Jul./Aug. 2012; pp. 041202-1-041202-8; vol. 30; No. 4; American Vacuum Society.
Lovicott, Dominick; "Electron Emission Thermal Energy Conversion"; Thesis presented to the Graduate School Faculty at the University of Missouri at Columbia; Jul. 2010; pp. 1-141 and 22 addit, pages which incl. title page, signature page, acknowledgements, abstract, table of contents, list of figures, list of tables, and nomenclature; University of Missouri—Columbia.
Mammana et al.; "Field Emission Device With Back Gated Structure"; J. Vac. Sci. Technol. A—Vacuum, Surfaces, and Films; Jul./Aug. 2004; pp. 1455-1460; vol. 22; No. 4; American Vacuum Society.
Marcus et al.; "Formation of Silicon Tips with <1 nm Radius"; Applied Physics Letters; Jan. 15, 1990; pp. 236-238; vol. 56; No. 3; American Institute of Physics.
Medvedev et al.; "Generation of Magnetic Fields in the Relativistic Shock of Gamma-Ray-Burst Sources"; The Astrophysical Journal; Dec. 1, 1999; pp. 697-706;vol. 526; The American Astronomical Society.
Milanovic et al.; "Micromachining Technology for the Lateral Field Emission Devices"; IEEE Transactions on Electron Devices; Jan. 2001; pp. 166-173; vol. 48; No. 1; IEEE.
Mimura et al.; "Improvement of the Emission Current from a Cesiated Metal-Oxide-Semiconductor Cathode"; Applied Physics Letters; bearing dates of Oct. 6, 2005, Feb. 6, 2006 and Mar. 24, 2006; pp. 123514-1-123514-3; vol. 88; American Institute of Physics.
Mishra et al.; "Model of Work Function of Tungsten Cathodes with Barium Oxide Coating"; Journal of Applied Physics; Mar. 15, 2004; pp. 3069-3074; vol. 95, No. 6; American Institute of Physics.
Nakpathomkum et al.; "Thermoelectric Efficiency at Maximum Power in Low-Dimensional Systems"; Oct. 7, 2010; pp. 1-13.
Nasibulin et al.; "A Novel Hybrid Carbon Material;" Nature Nanotechnology; Mar. 2007; pp. 156-161; vol. 2; Nature Publishing Group.
O'Dwyer et al.; "Electronic Efficiency in Nanostructured Thermionic and Thermoelectric Devices"; Physical Review B; bearing dates of 2005, Jun. 15, 2005, Sep. 6, 2005 and Nov. 21, 2005; pp. 205330-1-205330-10; vol. 72; Issue 205330; The American Physical Society.
Ottens et al.; "Near-Field Radiative Heat Transfer Between Macroscopic Planar Surfaces"; Physical Review Letters; Jul. 1, 2011; pp. 014301-1-014301-4; vol. 107, Issue 014301; American Physical Society.
Pan et al.; "Field Emission Heat Engines II"; Intellectual Ventures internal white paper; created on May 15, 2012 and printed on Aug. 2, 2012; pp. 1-43.
Pan et al.; "Field Emission Heat Engines"; printed on Dec. 28, 2011; 92 pp. total (incl. cover sheet, table of contents).
PCT International Search Report; Application No. PCT/US2012/071833; dated Mar. 8, 2013; pp. 1-3 (Plus 5 pages search history information).
PCT International Search Report; International App. No. PCT/US13/38476; dated Aug. 26, 2013; pp. 1-2.
PCT International Search Report; International App. No. PCT/US13/38249; Nov. 5, 2013; pp. 1-4.
PCT International Search Report; International App. No. PCT/US2012/071841; Mar. 1, 2013; pp. 1-2 (additional 4 pages of Search History).
PCT International Search Report; International App. No. PCT/US2012/071845; Mar. 4, 2013; pp. 1-3.
PCT International Search Report; International App. No. PCT/US2012/071849; Feb. 27, 2013; pp. 1-3 (additional 3 pages of Search History).
PCT International Search Report; International App. No. PCT/US2012/071837; Mar. 11, 2013; pp. 1-3 (plus 4 pages of search history information).
PCT International Search Report; International App. No. PCT/US2013/038254; Aug. 26, 2013; pp. 1-2.
PCT International Search Report; International App. No. PCT/US2013/038233; Oct. 4, 2013; pp. 1-5.
Rasor, Ned S.; "Thermionic Energy Conversion Plasmas"; IEEE Transactions on Plasma Science; Dec. 1991; pp. 1191-1208; vol. 19, No. 6; IEEE.
Schwede et al.; "Photon-Enhanced Thermionic Emission for Solar Concentrator Systems"; Nature Materials; Sep. 2010; pp. 762-767; vol. 9.
Shakouri, Ali; "Nanoscale Devices for Solid State Refrigeration and Power Generation"; 20th IEEE SEMI-THERM Symposium; bearing a date of 2004 and printed on Dec. 28, 2011; pp. 1-10; IEEE.
Shaw et al.; "Method and Structure for Local Emission Regulation and Arc Prevention in Field Emitter Arrays"; J.Vac. Sci. Technol. B; Mar./Apr. 2005; pp. 836-839; vol. 23; No. 2.

(56) References Cited

OTHER PUBLICATIONS

Spindt et al.; "Physical Properties of Thin-Film Field Emission Cathodes with Molybdenum Cones"; Journal of Applied Physics; Dec. 1976; pp. 5248-5263; vol. 47; No. 12; American Institute of Physics.

Tsu et al.; "Tunneling in a Finite Superlattice"; Appl. Phys. Lett.; Jun. 1, 1973; pp. 562-564; vol. 22, No. 11; American Institute of Physics.

Tuckerman et al.; High-Performance Heat Sinking for VLSI; IEEE Electron Device Letters; May 1981; pp. 126-129; vol. EDL-2, No. 5; IEEE.

Tuckerman et al.; "Microchannel Heat Transfer: Early History, Commercial Applications, and Emerging Opportunities"; Proceedings of the ASME 2011 9$^{th}$ International Conference on Nanochannels, Microchannels and Minichannels in Edmonton, Alberta, Canada; Jun. 19-22, 2011; pp. 1-18; ASME.

Vining, Cronin B.; "An Inconvenient Truth About Thermoelectrics"; Nature Materials; Feb. 2009; pp. 83-85; vol. 8; Macmillan Publishers Limited.

Westover, Tyler L.; "Energy Transport and Conversion in Electron Emission Processes"; A Disseratation submitted to the Faculty of Purdue University in West Lafayette, Indiana; Aug. 2008; pp. 1-236 plus addit. 20 pages incl. Dissertation Acceptance form, Research Integrity and Copyright Disclaimer form; title page, acknowledgements, table of contents, list of tables, list of figures, and abstract; ProQuest LLC, Ann Arbor, MI.

Yang et al.; "Monochromatic Electron Photoemission from Diamondoid Monolayers"; created on Aug. 2, 2012; 26 pages total (incl. Figs & Supporting Online Material addendum of 8 pgs.).

Zhu et al.; "Large Current Density from Carbon Nanotube Field Emitters"; Applied Physics Letters; Aug. 9, 1999; pp. 873-875; vol. 75; No. 6; American Institute of Physics.

Zhu, Wei; Vacuum Microelectronics (1st Edition); Sep. 21, 2001; 396 pages; ISBN-10: 047132244X and ISBN-13: 978-04713224443; Wiley-Interscience (entire book cited, but not provided).

* cited by examiner

APPLICATIONS OF GRAPHENE GRIDS IN VACUUM ELECTRONICS

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC § 119(e) for provisional patent applications, for any and all parent, grandparent, great-grandparent, etc. applications of the Priority Application(s)).

PRIORITY APPLICATIONS

The present application constitutes a continuation of U.S. patent application Ser. No. 14/706,485, entitled APPLICATIONS OF GRAPHENE GRIDS IN VACUUM ELECTRONICS, naming William David Duncan; Roderick A. Hyde; Jordin T. Kare; Max N. Mankin; Tony S. Pan; Lowell L. Wood, Jr. as inventors, filed 7 May, 2015.

- U.S. patent application Ser. No. 14/706,485 constitutes a continuation-in-part of U.S. patent application Ser. No. 14/613,459 entitled ELECTRONIC DEVICE MULTI-LAYER GRAPHENE GRID, naming William David Duncan; Roderick A. Hyde; Jordin T. Kare; Max N. Mankin; Tony S. Pan; Lowell L. Wood, Jr. as inventors, filed 4 Feb. 2015.
- U.S. patent application Ser. No. 14/706,485 also constitutes a continuation-in-part of U.S. patent application Ser. No. 13/612,129, entitled ELECTRONIC DEVICE GRAPHENE GRID, naming Roderick A. Hyde, Jordin T. Kare, Nathan P. Myhrvold, Tony S. Pan, Lowell L. Wood, Jr as inventors, filed 12 Sep. 2012.
- U.S. patent application Ser. No. 14/706,485 claims benefit of priority of U.S. Provisional Patent Application No. 61/993,947, entitled GRAPHENE GRIDS FOR VACUUM ELECTRONICS, PART II, naming William D. Duncan, Roderick A. Hyde, Jordin T. Kare, Max N. Mankin, Tony S. Pan, and Lowell L. Wood, Jr. as inventors, filed 15 May 2014, which was filed within the twelve months preceding the filing date of the present application or is an application of which a currently co-pending priority application is entitled to the benefit of the filing date.

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

SUMMARY

In one embodiment, an apparatus comprises: a cathode, an anode, and a first grid that are configured to form a vacuum electronic device, wherein the first grid is configured to modulate a flow of electrons between the cathode and anode in device operation; wherein the first grid includes at least two layers of graphene; and wherein the vacuum electronic device is configured with a set of device parameters that are selected according to a relative electron transmission through the first grid.

In one embodiment, a method comprises: providing a cathode, an anode, and a first grid, wherein the first grid includes at least two layers of graphene; and assembling the cathode, anode, and first grid to form a vacuum electronic device having a set of device parameters that are selected according to a relative electron transmission through the first grid.

In one embodiment, an apparatus comprises: a cathode, an anode, and a first grid that are configured to form a vacuum electronic device, wherein the first grid is configured to modulate a flow of electrons between the cathode and anode in device operation; wherein the first grid includes at least two layers of graphene; and wherein the first grid is curved such that the transmission rate of the flow of electrons is a function of an angle of approach of the flow of electrons.

In one embodiment a vacuum electronic device comprises: a cathode and a grid, wherein the grid is configured to modulate a flow of electrons emitted by the cathode in device operation; wherein the grid includes at least two layers of graphene and is characterized by an energy-dependent transmission spectrum; wherein the cathode and the grid are configured with a set of device parameters that are selected according to a relative electron transmission through the first grid; and wherein the cathode and the grid form at least a portion of at least one of a vacuum tube, a power amplifier, a klystron, a gyrotron, a traveling-wave tube, a field-emission triode, and a field emission display.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
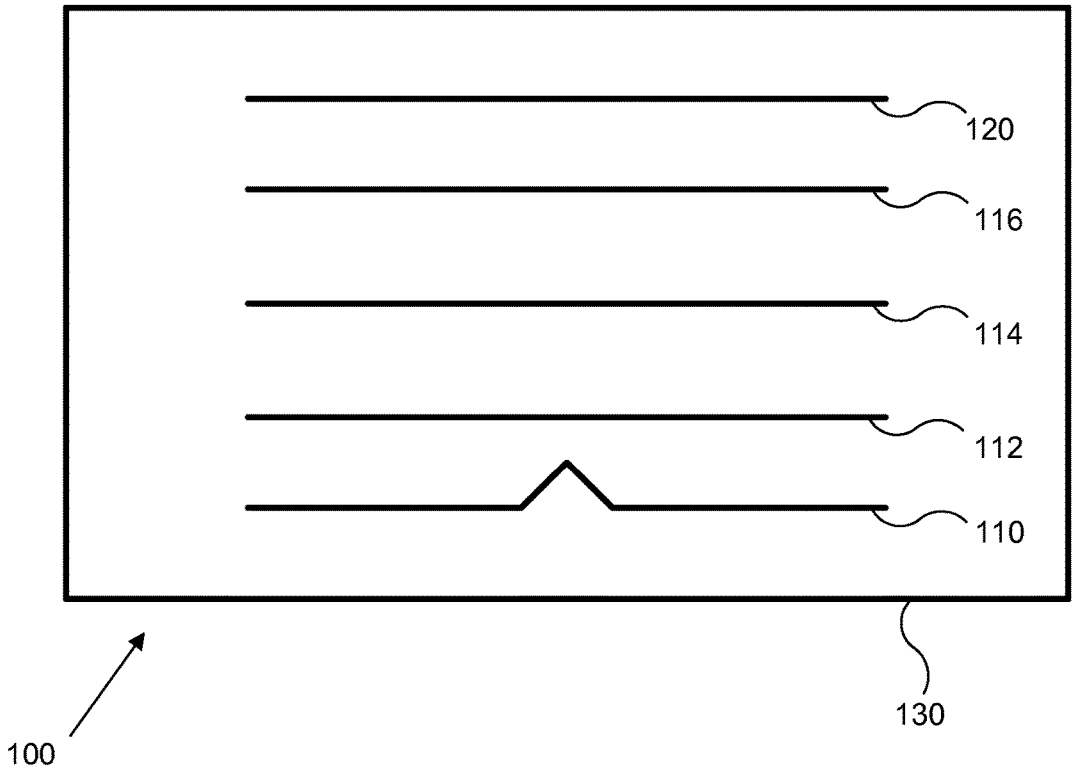
FIG. 1 is a schematic illustration of an exemplary multi-electrode electronic device.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

In accordance with the principles of the disclosure herein, one or more grid electrodes of an electronic device are made from multi-layer graphene materials.

FIG. 1 shows an example electronic device 100, in accordance with the principles of the disclosure herein. Electronic device 100 may, for example, be a microelectronic or a nanoelectronic device. Electronic device 100 may include an anode 110, a cathode 120 and one or more grid electrodes (e.g., grids 112-116). Electronic device 100 may be configured, for example, depending on the number and configuration of the grid electrodes therein, to operate as a triode, a tetrode, a pentode or other type of electronic device. In particular, electronic device 100 may be configured to operate as a field emission device that is shown and described in U.S. patent application Ser. No. 13/374,545.

In conventional usage, the term cathode refers to an electron emitter and the term anode refers to an electron receiver. However, it will be understood that in the electronic devices described herein the cathode and the anode may each act as an electron emitter or an electron receiver and therefore the terms anode and cathode may be understood by context herein. Under appropriate biasing voltages, a charged carrier flow may be established in electronic device 100 between anode 110 and cathode 120. Anode 110 and/or cathode 120 surfaces may include field enhancement structures (e.g., field emitter tips, ridges, carbon nanotubes, etc.)

The charged carrier flow between anode 110 and cathode 120 may be controlled or otherwise influenced by the grid electrodes (e.g., grids 112-116). In the example shown, grids 112-116 may act, for example, as a control grid, a screen grid and a suppressor grid. The grid electrodes may control (i.e. modulate) the amount of the charged carrier flow between anode 110 and cathode 120 in the same manner as homonym grids control the charged carrier flow in traditional vacuum tubes by modifying the electrical potential profile or electrical field in the direction of the charged carrier flow between anode and cathode under appropriate biasing voltages. A positive bias voltage applied to a grid may, for example, accelerate electrons across the gap between anode 110 and cathode 120. Conversely, a negative bias voltage applied to a grid may decelerate electrons and reduce or stop the charged carrier flow between anode 110 and cathode 120.

Electronic device 100 may be encased in container 130, which may isolate anode 110, cathode 120 and the one or more grid electrodes in a controlled environment (e.g., a vacuum or gas-filled region). The gas used to fill container 130 may include one or more atomic or molecular species, partially ionized plasmas, fully ionized plasmas, or mixtures thereof. A gas composition and pressure in container 130 may be chosen to be conducive to the passage of charged carrier flow between anode 110 and cathode 120. The gas composition, pressure, and ionization state in container 130 may be chosen to be conducive to the neutralization of space charges for charged carrier flow between anode 110 and cathode 120. The gas pressure in container 110 may, as in conventional vacuum tube devices, be substantially below atmospheric pressure. The gas pressure may be sufficiently low, so that the combination of low gas density and small inter-component separations reduces the likelihood of gas interactions with transiting electrons to low enough levels such that a gas-filled device offers vacuum-like performance.

In accordance with the principles of the disclosure herein one or more of the electrodes (e.g., electrodes 112-116) in electronic device 100 may be made of graphene materials. The graphene materials used as electrode material may be substantially transparent to the flow of charged carriers between anode 110 and cathode 120 in device operation. Electronic device 100 may include at least one control grid configured to modulate a flow of electrons from the cathode to anode. Additionally or alternatively, electronic device 100 may include at least one screen grid configured to reduce parasitic capacitance and oscillations. The control grid and/or the screen grid may be made of graphene material.

Figure 2:
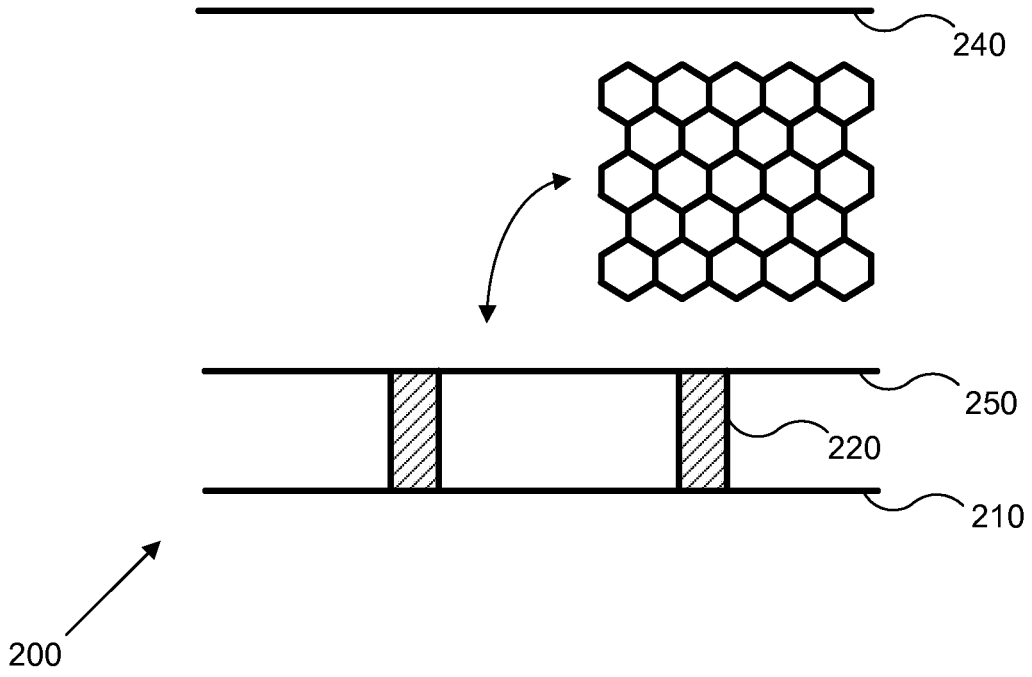
FIG. 2 is a schematic illustration of a device in which a grid electrode made of graphene materials is disposed proximate to an anode or cathode electrode.

FIG. 2 shows an example device 200 (which may be a version of multi-electrode device 100) having two electrodes 210 and 240 (e.g., cathode and anode) and a grid electrode 250 disposed proximate to one of the electrodes (e.g., electrode 210). Grid electrode 250 may incorporate graphene materials which are substantially transparent to a flow of electrons between electrodes 210 and 240. In device operation, the electrons flow between electrodes 210 and 240 may include electrons having energies, for example, of up to about 100 eV. Grid electrode 250 may, for example, be a control grid configured to modulate a flow of electrons from the cathode to anode. The control grid may be disposed sufficiently close to electrode 210 to induce or suppress electron emission from electrode 210 when a suitable electric potential is applied to the grid in device operation.

Graphene is an allotrope of carbon having a structure of one-atom-thick planar sheets of $sp^2$-bonded carbon atoms that are densely packed in a honeycomb crystal lattice, as shown, for example, in the inset in FIG. 2. The graphene materials may be in the form of sheets or ribbons and may include unilayer, bilayer or other forms of graphene. The graphene material of the control grid (e.g., grid electrode 250) may include a graphene sheet having an area of more than 0.1 $\mu m^2$.

A version of device 200 may have at least one relatively smooth planar anode or cathode surface over which graphene grid electrode 250 may be supported by a sparse array of conducting posts or walls. The conducting posts or walls may terminate on but are electrically isolated from the underlying anode or cathode. Grid electrode 250 may be formed, for example, by suspending free-standing graphene materials supported by scaffolding 220 over electrode 210. The smooth planar anode or cathode surface over which graphene grid electrode 250 may be supported may be a surface that is substantially planar on a micro- or nanometer scale. Further, a separation distance between the graphene material and the planar surface may be less than about 1 μm. In some experimental investigations of suspended graphene sheets, a separation distance between the graphene material and the planar surface is about 0.3 μm. In some device applications, the separation distance between the graphene material and the planar surface may be less than about 0.1 μm.

Scaffolding 220 may be configured to physically support the graphene material of grid electrode 250 over the planar surface of electrode 210. Scaffolding 220 may, for example, include an array of spacers or support posts. The spacers or support posts, which may include one or more of dielectrics, oxides, polymers, insulators and glassy material, may be electrically isolated from the planar surface of electrode 210.

Graphene, which has a local hexagonal carbon ring structure, may have a high transmission probability for electrons through the hexagonal openings in its structure. Further, electronic bandgaps in the graphene materials used for grid 250 may be suitably modified (e.g., by doping or functionalizing) to reduce or avoid inelastic electron scattering of incident electrons that may pass close to a carbon atom in the graphene structure. The doping and functionalizing techniques that are used to create or modify electronic bandgaps in the graphene materials may be the same or similar to techniques that are described, for example, in Beidou Guo et al. *Graphene Doping: A Review*, J. Insciences. 2011, 1(2), 80-89, and in D. W. Boukhvalov et al. *Chemical functionalization of graphene, J. Phys.: Condens. Matter* 21 344205. For completeness, both of the foregoing references are incorporated by reference in their entireties herein.

The transmission probability of electrons through graphene is discussed in e.g.: Y. J. Mutus et al. *Low Energy Electron Point Projection Microscopy of Suspended Graphene, the Ultimate* "Microscope Slide," *New J. Phys.* 13 063011 (reporting measured transparency of graphene to electrons 100-200 eV to be about 74%); J. Yan et al. *Time-domain simulation of electron diffraction in crystals*, Phys. Rev. B 84, 224117 (2011) (reporting the simulated transmission probability of low-energy electrons (20-200 eV) to be greater than about 80%); J. F. McClain, et. al., *First-principles theory of low-energy electron diffraction and quantum interference in few-layer graphene*, arXiv: 1311.2917; and R. M. Feenstra, et al., *Low-energy electron reflectivity from graphene*, PHYSICAL REVIEW B 87, 041406(R) (2013).

However, as noted above, because of inelastic scattering processes, incident electrons may be expected to suffer detrimental energy losses due to interactions with electrons and phonons in graphene materials. These interactions may be expected to become dominant if the incident electron kinetic energy matches a relevant interaction energy. Fortunately, in graphene, optical phonons may have typical energies of about 200 meV, and acoustic phonons may have energies ranging from 0 to 50 meV. Therefore, ignoring electron-electron scattering, the tunneling or transmission probability of vacuum electrons through graphene may be expected to be close to unity for electrons having an energy >>1 eV. Electron-phonon interactions may not be important or relevant to the transparency of the graphene grids to electron flow therethrough in electronic device operation.

In accordance with the principles of the disclosure herein, any effects of electron-electron scattering on the transparency of the graphene materials may be avoided or mitigated by bandgap engineering of the graphene materials used to make grid 250. Typical electric transition energies in raw or undoped graphene materials may be about 100 meV around the Dirac point. However, the electric transition energies may be expected to increase up to about 10 eV under very strong electric fields that may be applied in operation of device 200. Moreover, a concentration of induced charge carriers in graphene may be dependent on the external electric field with the proportionality between the induced charge carriers and the applied electric field of about 0.055 electrons/nm$^2$ per 1 V/nm electric field in vacuum. In accordance with the principles of the disclosure herein, energy losses due to electron-electron scattering in the graphene materials under a strong electric fields may be avoided, as noted above, by bandgap engineering of the graphene materials used for grid electrode 250. The graphene materials used for grid 250 may be provided with electronic bandgaps at suitable energies to permit through transmission of electron flow between electrodes 210 and 240 in device operation. The graphene materials with electronic bandgaps may be functionalized and/or doped graphene materials. Alternatively, we can use other two-dimensional atomic crystals with intrinsic electronic bandgaps, such as hexagonal boron nitride, molybdenum disulphide, tungsten diselenide, and other dichalcogenides and layered oxides.

Figure 3:
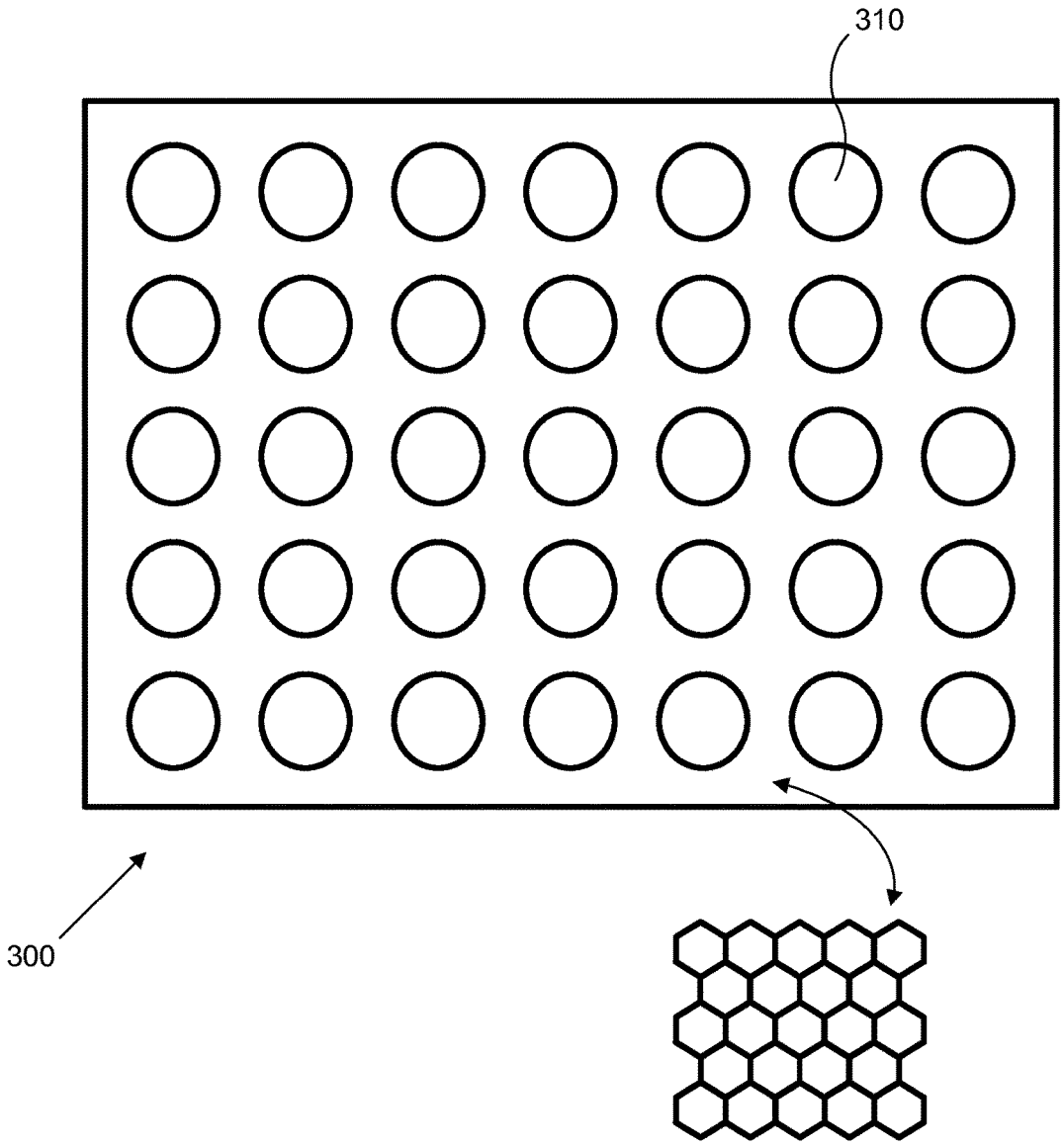
FIG. 3 is a schematic illustration of an example graphene sheet in which carbon atoms have been removed to form holes or apertures through which charge carriers may flow uninterrupted.

In another version of multi-electrode device 100, the graphene materials used for an electrode may have holes or apertures formed therein to permit through passage of a flow of charged carriers between anode 110 and cathode 120 in device operation. The holes, which may be larger than a basic hexagon carbon ring or unit of graphene's atomic structure, may be formed by removing carbon atoms from a graphene sheet or ribbon. FIG. 3 shows schematically a graphene sheet 300 in which carbon atoms have been removed to form holes or apertures 310 through which charge carriers may flow uninterrupted.

Holes or apertures 310 (which may also be referred to herein as "pores") may be physically formed by processing graphene using any suitable technique including, for example, electron beam exposure, ion beam drilling, copolymer block lithography, diblock copolymer templating, and/or surface-assisted polymer synthesis. The named techniques are variously described, for example, in S. Garaj et al. *Graphene as a subnanometre trans-electrode membrane*, Nature 467, 190-193, (9 Sep. 2010); Kim et al. *Fabrication and Characterization of Large-Area, Semiconducting Nanoperforated Graphene Materials*, Nano Lett., 2010, 10 (4), pp. 1125-1131; D. C. Bell et al. *Precision Cutting and Patterning of Graphene with Helium Ions*, Nanotechnology 20 (2009) 455301; and Marco Bieri et al. *Porous graphemes: two-dimensional polymer synthesis with atomic precision*, Chemical Communications, 45 pp. 6865-7052, 7 Dec. 2009. For completeness, all of the foregoing references are incorporated by reference in their entireties herein.

Alternatively or additionally, nano-photolithographic and etching techniques may be used to create a pattern of holes in the graphene materials used as an electrode. In an example hole-forming process, graphene deposited on a substrate may be patterned by nanoimprint lithography to create rows of highly curved regions, which are then etched away to create an array of very small holes in the graphene material. The process may exploit the enhanced reactivity of carbon atoms along a fold or curve in the graphene material to preferentially create holes at the curved regions.

For a version of multi-electrode device 100 in which an electrode (e.g., electrode 110) has a surface topography that includes, for example, an array of field emitter tips for enhanced field emission, a graphene sheet used for a proximate grid electrode (e.g., electrode 112) may be mechanically placed on the array of field tips. Such placement may be expected to locally curve or mechanically stress the graphene sheet, which after etching may result in apertures or holes that are automatically aligned with the field emitter tips.

In an example multi-electrode device 100, the graphene material used for making a grid electrode includes a graphene sheet with physical pores formed by carbon atoms removed therein. A size distribution of the physical pores may be selected upon consideration of device design parameters. Depending on the device design, the pores may have cross-sectional areas, for example, in a range of about 1 $nm^2$-100 $nm^2$ or 100 $nm^2$-1000 $nm^2$.

The foregoing example grid electrodes made of graphene materials (e.g., electrode 250) may be separated from the underlying electrode (e.g., electrode 210) by a vacuum or gas-filled gap.

Figure 4:
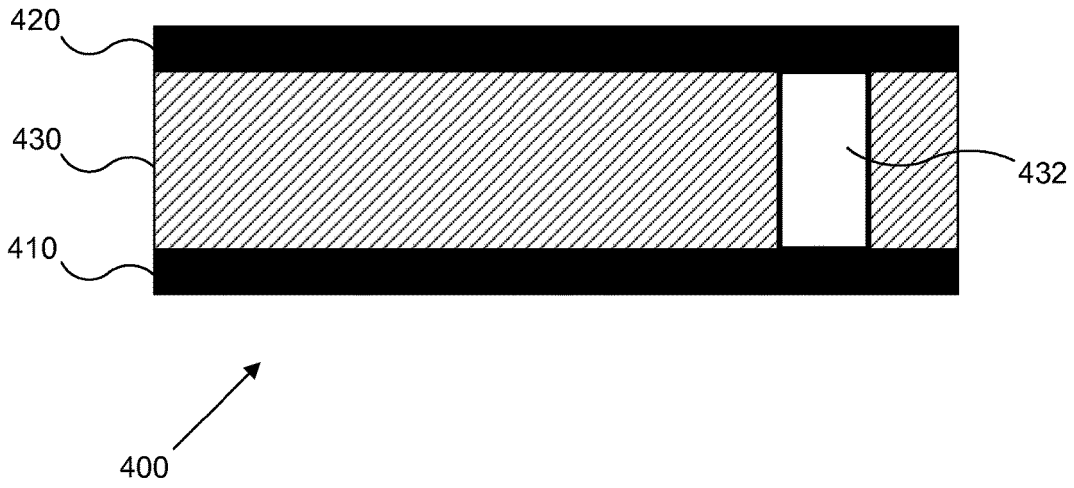
FIG. 4 is a schematic illustration of an example configuration of a grid electrode made of graphene material that is supported over an underlying electrode by an intervening dielectric spacer layer.

In an alternate version of the multi-electrode devices of this disclosure, a grid electrode made of graphene materials may be separated from the underlying electrode by a dielectric spacer layer. FIG. 4 shows an example configuration 400 of a grid electrode 420 made of graphene material that is separated from an underlying electrode 410 by a dielectric spacer layer 430. Materials and dimensions of dielectric spacer layer 430 may be selected so that in device operation a large portion of the electron flow to or from electrode 410 can tunnel or transmit through both dielectric spacer layer 430 and grid electrode 420 without being absorbed or scattered. Dielectric spacer layer 430 may, for example, be of the order of a few nanometers thick. Further, like the graphene electrodes discussed in the foregoing, dielectric spacer layer 430 may be a continuous layer or may be a porous layer with holes or apertures (e.g., hole 432) formed in it. The holes of apertures 432 in dielectric spacer layer 430 may be formed, for example, by etching the dielectric material through holes or apertures (e.g., holes 310) in grid electrode 420. In such case, holes of apertures 432 in dielectric spacer layer 430 may form vacuum or gas-filled gaps between electrodes 410 and 420.

In a version of multi-electrode device 100, graphene material of a control grid may be supported by an intervening dielectric material layer disposed on the planar surface of the underlying electrode. The intervening dielectric material layer may be configured to allow tunneling or transmission of the electron flow therethrough. Further, the intervening dielectric material layer may be partially etched to form a porous structure to support the graphene grid over the underlying electrode.

Figure 5:
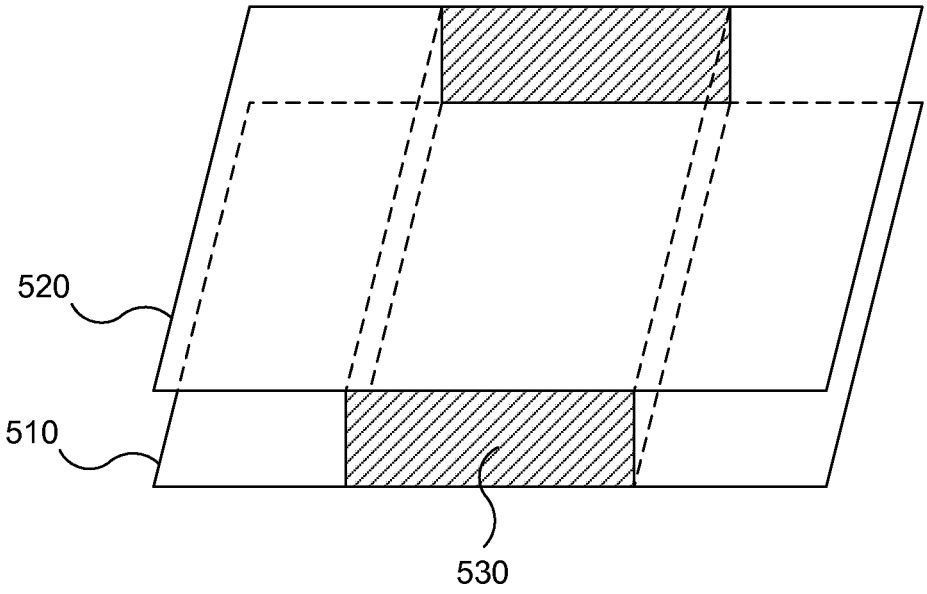
FIG. 5 is a schematic illustration of an example arrangement of a pair of electrodes, which may be used in an electronic device.

FIG. 5 shows an example arrangement 500 of a pair of electrodes (e.g., first electrode 510 and second electrode 520), which may be used in an electronic device. The pair of electrodes 510 and 520 may be disposed in a vacuum-holding container (e.g., container 130, FIG. 1). Second electrode 520 may be disposed in close proximity to first electrode 510 and configured to modulate or change an energy barrier to a flow of electrons through the surface of first electrode 510. Additionally or alternatively, second electrode 520 may be disposed in the vacuum-holding container and configured to modulate a flow of electrons through the second electrode itself.

Second electrode 520 may be made of a 2-d layered material including one or more of graphene, graphyne, graphdiyne, a two-dimensional carbon allotrope, and a two-dimensional semimetal material. The 2-d layered material may have an electron transmission probability for 1 eV electrons that exceeds 0.25 and/or an electron transmission probability for 10 eV electrons that exceeds 0.5.

The 2-d layered material of which the second electrode is made may have an electronic bandgap therein, for example, to permit transmission of the electron flow therethrough in operation of device. The 2-d layered material may, for example, be doped graphene material or functionalized graphene material.

Second electrode 520 may be disposed next to a surface of first electrode 510 so that it is separated by a vacuum gap from at least a portion of the surface of first electrode 510. Alternatively or additionally, second electrode 520 may be disposed next to the surface of first electrode 510 supported by a dielectric material layer 530 disposed over the surface of first electrode 510. Dielectric material layer 530 disposed over the surface of first electrode 510 may be about 0.3 nm-10 nm thick in some applications. In other applications, dielectric material layer 530 may be greater than 10 nm thick.

Dielectric material layer 530 disposed over the surface of first electrode 510 may be a continuous dielectric material layer which is configured to allow tunneling or transmission therethrough of substantially all electron flow to and from the first electrode in device operation. Dielectric material layer 530 may, for example, be a porous dielectric material layer configured to permit formation of vacuum gaps between first electrode 510 and second electrode 520. The 2d-layer material of second electrode 520 may have pores therein permitting chemical etching therethrough to remove portions of dielectric material layer 530 to form, for example, the vacuum gaps.

The dimensions and materials of the devices described herein may be selected for device operation with grid and anode voltages relative to the cathode in suitable ranges. In one embodiment the dimensions and materials of a device may be selected for device operation with grid and anode voltages relative to the cathode, for example, in the range of 0 to 20 volts. In another embodiment the dimensions and materials of a device may be selected for device operation with grid and anode voltages relative to the cathode, for example, in the range of 0 to 100 volts. In yet another embodiment the dimensions and materials of a device may be selected for device operation with grid and anode voltages relative to the cathode, for example, in the range of 0 to 10,000 volts.

Figure 6:
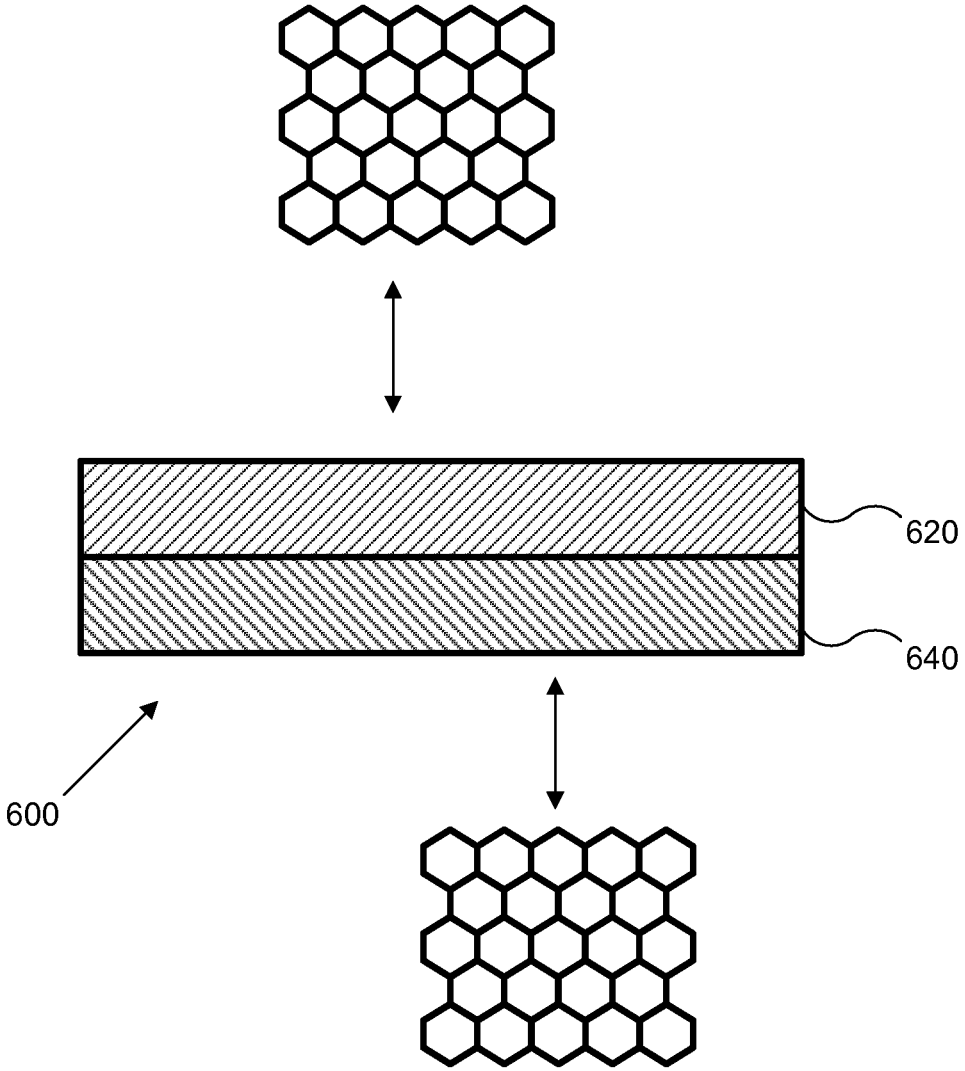
FIG. 6 is a schematic illustration of a multi-layer graphene grid.

In some embodiments, one or more of the grid electrodes as previously described herein may comprise more than one layer of graphene (a multi-layer graphene grid 600) as shown in FIG. 6. In such an embodiment where the multi-layer graphene grid 600 is incorporated in an electronic device such as electronic device 100 shown in FIG. 1, transmission of charged particles through the multi-layer graphene grid 600 may be tuned and/or optimized by tailoring the energy distribution of the electron beam. In this embodiment the layers 620, 640 together behave like a Fabry-Pérot style interferometer where quantum interference effects account for minima and maxima in the transmission of charged particles through the multi-layer graphene grid 600 as a function of the electron energy, where the quantum interference effects may be most pronounced for electrons having energies less than 50 eV.

Figure 7:
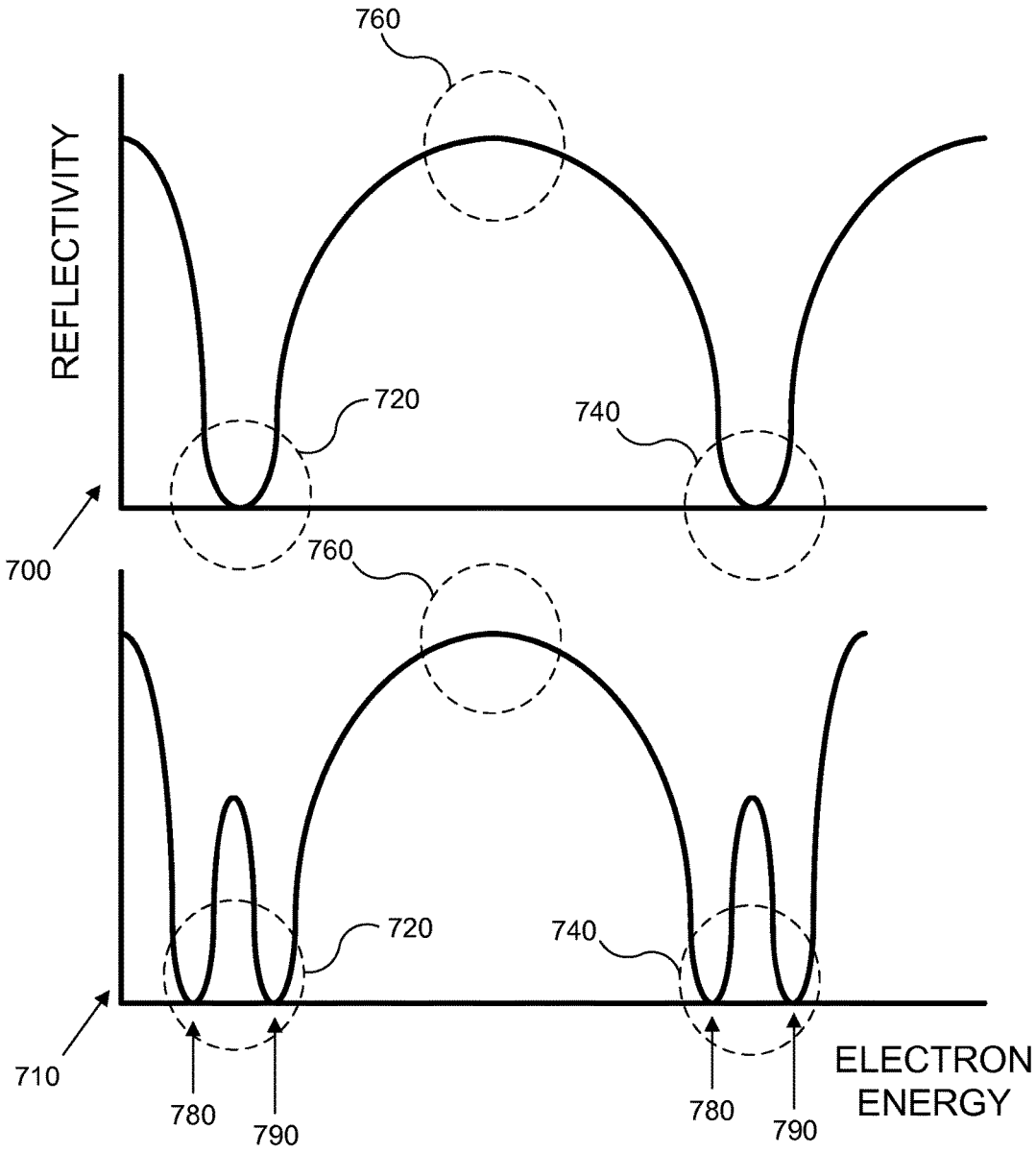
FIG. 7 is a schematic of a reflectivity spectrum corresponding to a multi-layer graphene grid.

Examples of reflectivity spectra 700, 710 (the inverse of the transmission spectrum) are shown in FIG. 7, where the top spectrum 700 corresponds to a multi-layer graphene grid having two graphene layers and the bottom spectrum 710 corresponds to a multi-layer graphene grid having three graphene layers. The reflectivity spectra 700, 710 correspond to the reflection probability of electrons as a function of electron energy. For multi-layer graphene grids 600 having two or more graphene layers 620, 640, two minima 720, 740 appear in the reflectivity spectrum. These minima 720, 740 in the reflectivity spectrum correspond to maxima in a corresponding transmission spectrum. The first minimum 720 appears between 0-6 ev, and the second minimum 740 appears between 14-21 eV. Within each minimum 720, 740 the reflectivity spectrum for a multi-layer graphene grid having n layers of graphene shows n−1 sub-minima in the reflectivity. For example, for spectrum 700 corresponding to a multi-layer graphene grid having two layers, each minimum 720, 740 includes no sub-minima, and for spectrum 710 corresponding to a multi-layer graphene grid having three layers, each minimum 720, 740 includes two sub-minima 780,790. Near complete reflection is found for energies between the minima 720, 740, i.e. at location 760.

FIG. 7 is sketched for illustrative purposes, and in some embodiments the reflectivity spectra 700, 710 may deviate from these figures. Further, although the reflectivity spectra for two and three graphene layers are shown in FIG. 7, other embodiments may include more than three graphene layers, may include doped graphene, may include graphene layers separated by a spacer layer, and/or may deviate from the configurations corresponding to FIG. 7 in other ways. In practice, one of skill in the art may determine the reflectivity spectrum and/or the transmission spectrum corresponding to a particular multi-layer graphene grid experimentally and/or numerically to determine optimal operating conditions for the grid in a device.

There are a number of ways that electron transmission through the multi-layer graphene grid 600 can be varied and/or optimized. First, transmission can be varied according to the number of graphene layers in the multi-layer graphene grid 600, where the number of graphene layers may also be selected according to an optimal mechanical strength of the grid.

Figure 8:
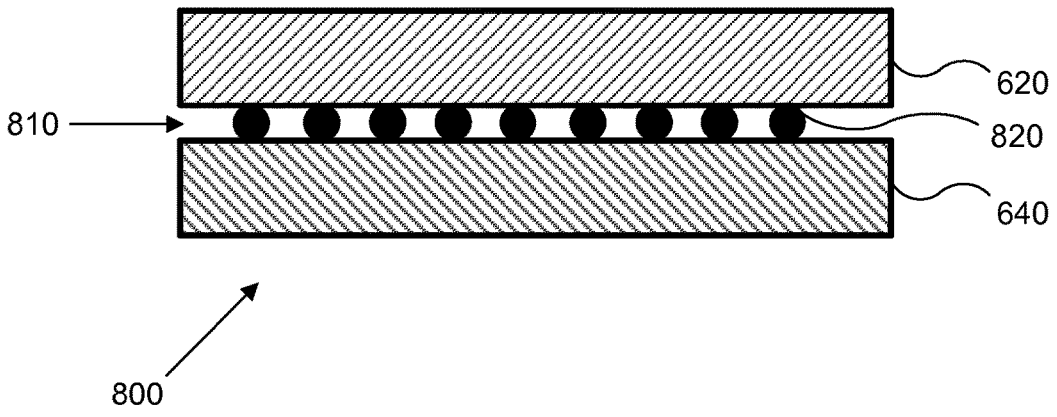
FIG. 8 is a schematic illustration of a multi-layer graphene grid having a gap.

Further, in some embodiments the layers 620, 640 of the graphene grids may be separated by a gap 810, as shown in FIG. 8. The separation between the graphene layers 620, 640 can be achieved by adding interstitial atoms and/or molecules, represented by elements 820 in FIG. 8. Creating a gap 810 has the effect of moving the minima and maxima (720, 740, 760) of the reflectivity spectrum since energies corresponding to these maxima and minima are determined by wavelength interference considerations.

In an embodiment where the multi-layer graphene grid 600 is incorporated in an electronic device 100 such as that shown in FIG. 1, the energy of the electron at the location of the grid 600 can be varied according to the grid position in the device 100, the position and/or voltage bias of other grids in the device, the voltage bias of the multi-layer graphene grid and/or the anode, the cathode temperature, cathode photoemission considerations, magnetic fields, or other factors.

The electron energy can also be optimized according to other considerations such as inelastic scattering. For example, the inelastic scattering cross section of electrons with carbon materials drops dramatically below about 40 eV. For electrons below 4 eV, the inelastic mean free path of electrons could be about 10 nm, which is much greater than the thickness of typical graphene sheets (monolayer graphene is only about 0.3 nm thick). Accordingly, the energy of the electrons at the location of the grid 600 can be selected to minimize the effects of inelastic scattering while simultaneously maximizing transmission probability.

Figure 9:
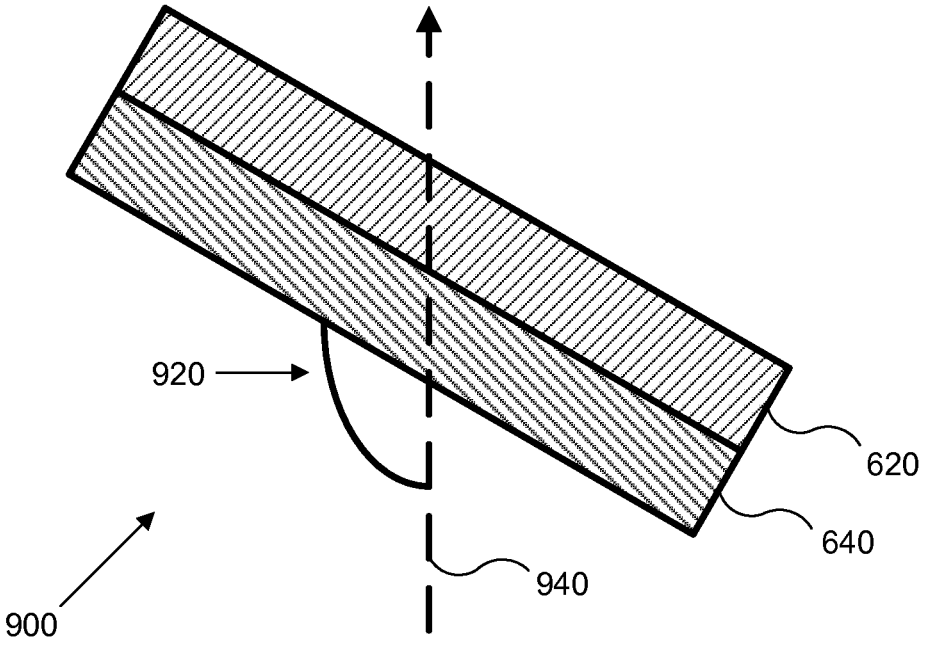
FIG. 9 is a schematic illustration of a multi-layer graphene grid at an angle with an electron beam.

In another embodiment, the reflectivity spectrum corresponding to a particular multi-layer graphene grid 600 can be effectively changed by varying the incident angle 920 of an incoming beam 940 as shown in FIG. 9. By varying the incident angle 920, this changes the effective thickness of the graphene layers 620, 640 as seen by the incoming bean 940, therefore changing the conditions for interference of the beams reflected from each of the layers 620, 640. In practice, for an electronic device such as that shown in FIG. 1, the incident angle 920 can either be changed by moving/rotating the multi-layer graphene grid 600 (where the multi-layer graphene grid 600 could be one or more of the grids 112-116 shown in FIG. 1), or by deviating the incoming beam 940, such as with charged particle optics.

Figure 10:
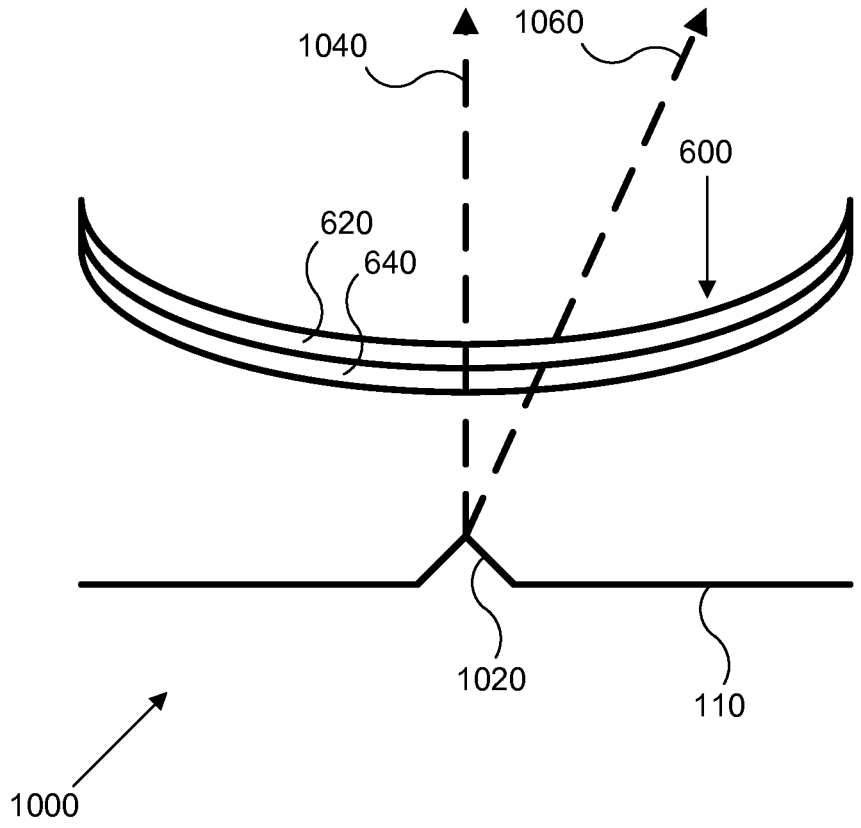
FIG. 10 is a schematic illustration of a curved multi-layer graphene grid and a cathode with a ridge emitter.

FIG. 10 shows an embodiment 1000 of a cathode 110 having an emitter 1020 and a curved multi-layer graphene grid 600, where in this embodiment the multi-layer graphene grid 600 is shown having two layers 620, 640. FIG. 10 shows two potential paths 1040, 1060 for electron beams through the grid 600. The two paths 1040, 1060 pass through the grid 600 at different angles, causing them to travel different distances through the grid 600. Thus, the grid thickness can effectively be varied according to the incident angle of the electron beam, which can be tuned using electron optics. In the embodiment shown here the emitter 1020 can be a point-emitter, where the grid can either be a portion of a cylinder or a portion of a sphere. In another embodiment the emitter 1020 can be ridge-shaped where the grid is a sheet that extends along the ridge.

The embodiments herein can also be generalized to single-layer grids, where curvature of the grid as shown in FIG. 10, and/or the tilted grid of FIG. 9 can be used with means of controlling the path of the electrons to effectively change the distance through which the electron beam travels in the grid.

In another embodiment the reflectivity spectrum can be changed by adjusting the strain/bending the multi-layer graphene grid 600, by effectively changing the band structure of the grid.

In other embodiments the concepts as described above may be applied to materials other than graphene that are substantially transparent to a flow of electrons and can be stacked similarly to graphene, for example two-dimensional atomic crystals such as boron nitride, molybdenum disulphide, tungsten diselenide, and other dichalcogenides and layered oxides. Further, in some embodiments two different materials such as carbon and boron nitride may be stacked together, for strength or durability or according to a desired composite reflectivity spectrum.

In different embodiments, the graphene grids as described herein may include a grid mesh made of intersecting graphene nanoribbons, and/or an array of carbon nanotubes.

Figure 11:
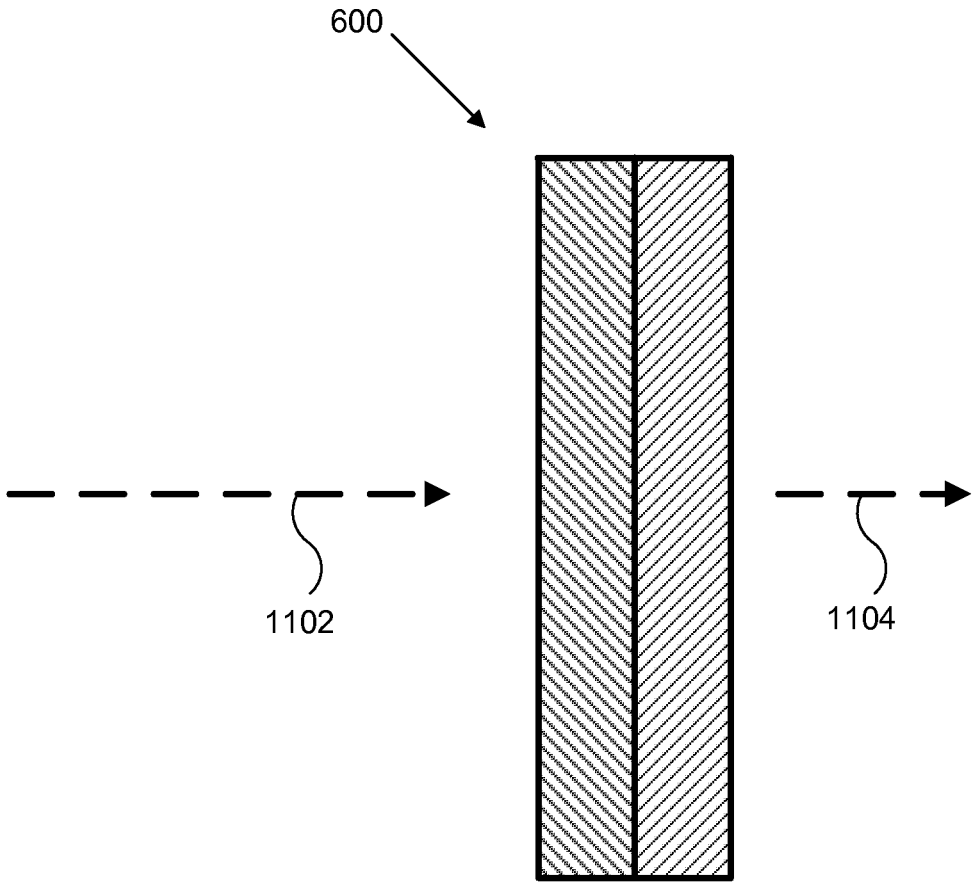
FIG. 11 is a schematic illustration of a multi-layer graphene grid used as an energy filter.

In one embodiment a multilayer graphene grid as described herein can be used as a tunable energy and/or momentum filter for charged particle as depicted in FIG. 11. For example, the multilayer graphene grid 600 can be incorporated in a vacuum electronic device such as a vacuum tube, a power amplifier, a klystron, a gyrotron, a traveling-wave tube, a field-emission triode, a field emission display, a mass spectrometer, an ion thruster, or a different vacuum electronic device. In such an embodiment the graphene grid 600 is inserted into the device to modulate a flow of electrons 1102. The graphene grid 600 is configured to pass charged particles in a selected energy range (the passed charged particles are represented in FIG. 11 by element 1104) and to block charged particles outside of that energy range. The location and configuration of the multilayer graphene grid in this embodiment is selected according to the considerations as described herein, and according to the desired energy range of the filter. The energy range of the passed charged particles is a function of a potential applied to the grid, therefore the energy range of the filter is tunable according to the applied potential. The multilayer graphene grid used as an energy filter may be configured according to the other embodiments of multilayer graphene grids as described herein.

Figure 12:
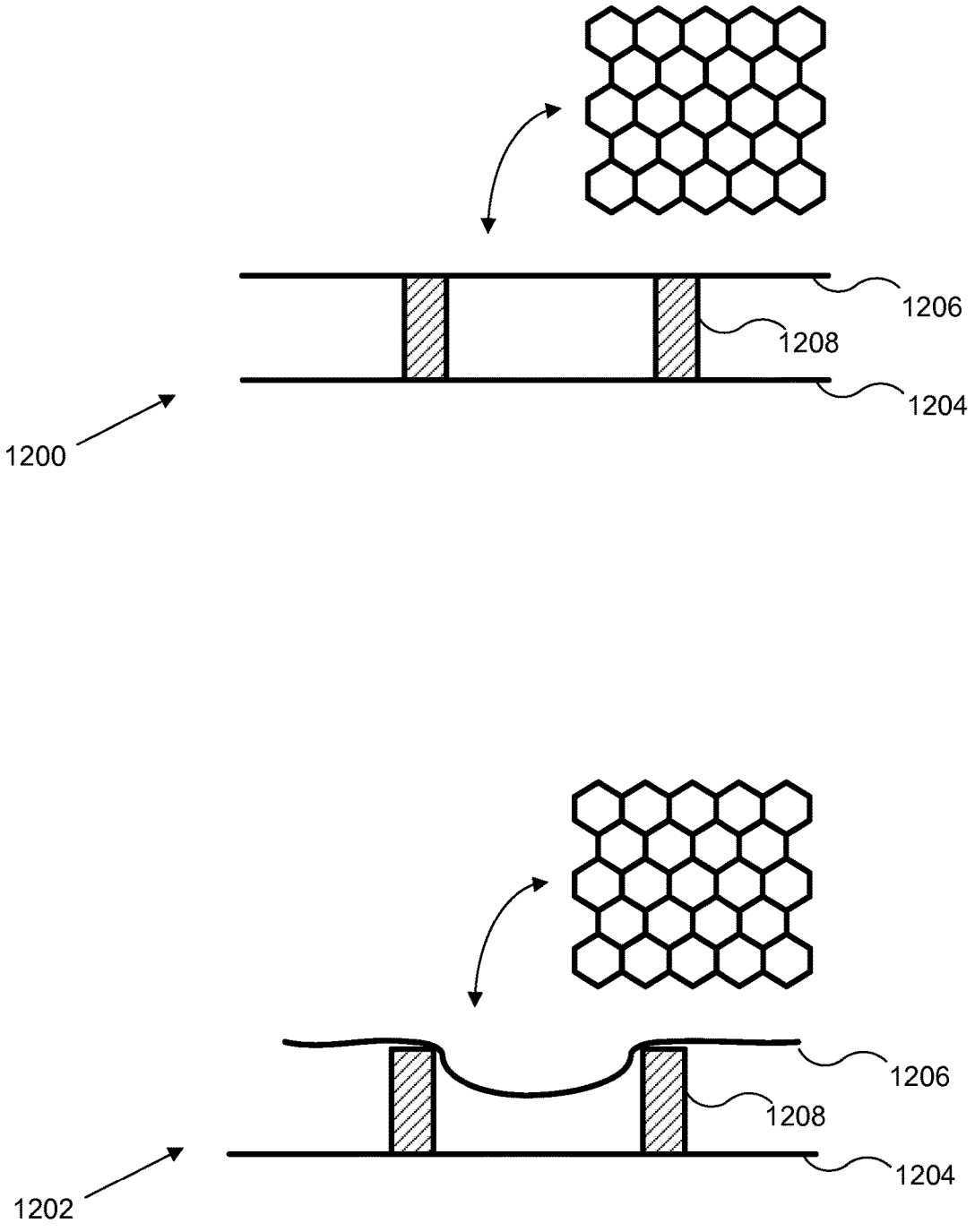
FIG. 12 is a schematic illustration of deformable graphene grid.

FIG. 12 shows an embodiment of a field emitter (similar to that shown in FIG. 2) including a graphene grid 1206 that may be a single or multilayer grid, where the grid is configured to deform in response to an input. The field emitter with the grid in its initial state 1200 is shown in the top portion of FIG. 12 and the field emitter with the grid in the deformed state 1202 is shown in the bottom portion of FIG. 12. In this embodiment the cathode 1204 and the graphene grid 1206 are operably connected to a power supply to produce an electric field between the cathode and the grid, wherein this electric field causes electron emission from the cathode. When the grid bends, as shown by the deformed state 1202, this changes the electric field between the cathode and the grid and can increase electron emission from the cathode. In this embodiment, insulating supports 1208 hold up the graphene grid 1206 and prevent it from shorting with the cathode 1204. FIG. 12 is just one exemplary embodiment showing how the grid 1206 can deform, and the actual deformation may differ in appearance from what is shown in FIG. 12.

As an example of an electrical force that causes the graphene grid 1206 to bend, when there is a voltage differential between the graphene grid and cathode 1204, a graphene grid that is suspended by insulating supports 1208 as shown in FIG. 12 can deform and move due to electrostatic attraction such that certain areas of the graphene grid 1206 become closer to the cathode. This electrostatic attraction is analogous to electrostatically-driven diaphragms in loudspeakers. Since the distance between the graphene grid and the cathode is reduced, the field strength in between the two is enhanced, thus enhancing electron emission from the cathode.

There are a number of other ways that the grid can be made to deform. In some embodiments, the input that the graphene grid is responsive to is an electrical force, a magnetic force, a mechanical force, an acoustic force, or a different kind of force. In some embodiments the field emitter includes one or more additional grids (a field emitter with multiple grids is shown in FIG. 1) that are configured to change the electric field proximate to the graphene grid 1206, thereby applying a force to the grid 1206 in order to deform it. In some embodiments, the graphene grid is pretensioned in order to adjust the amount of its deformation responsive to one or more forces.

In some embodiments, the graphene grid 1206 is fabricated such that it is non-homogeneous, in order to facilitate bending of the grid in one or more regions. For example, the graphene grid 1206 may be deliberately "buckled" in advance, providing one or more regions where the graphene grid is more likely to bend. This may be accomplished, for example, by fabricating the graphene grid on a substrate at a first temperature, and then cooling the substrate so it contracts, and then rely on the field to ensure that all the bumps are pulled towards the surface (or, alternatively, pulled away from the surface by charging a second electrode above the graphene grid, and the second electrode may later be removed once it's done its job). Another way of buckling the graphene grid is to transfer the graphene grid to a strained polymer substrate and then relax the polymer. The strained nanostructures could then be stamped from the polymer onto other substrates.

Figure 13:
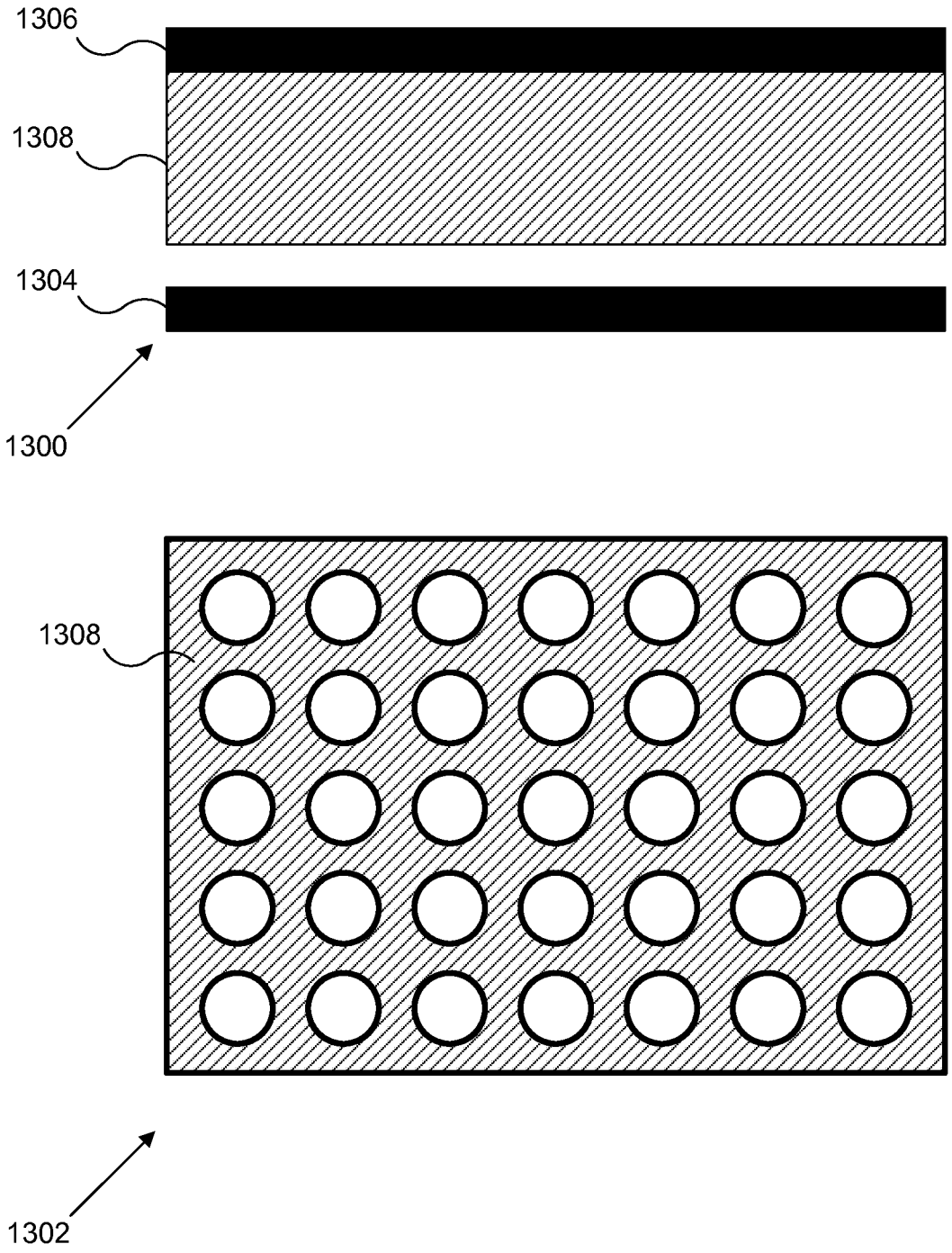
FIG. 13 is a schematic illustration of graphene grid on a support structure with apertures.

FIG. 13 shows an embodiment of a graphene grid 1306 configured on a support structure, wherein the support structure is configured with an array of apertures through which electrons from a cathode 1304 can pass. A side cross-sectional view of the graphene grid 1306, support structure 1308, and cathode 1304 is shown by element 1300, and a top view of the support structure 1308 is shown by element 1302. In such an embodiment the support structure 1308 is configured to hold up the graphene grid 1306 relative to the cathode 1304 while still allowing electrons from the cathode 1304 to pass. In some embodiments the support structure may be called a mesh.

The support structure 1308 can be made from a variety of materials in a variety of configurations. In some embodiments, the support structure includes polymers, silicon oxides, silicon nitride, and other dielectric materials. In some embodiments the support structure includes one or more insulators, where the insulator may be configured with conductive wires that may be electrically connected to the cathode 1304, the graphene grid 1306, or both, for reducing charge buildup on the graphene grid 1306 or for other reasons. In some embodiments the support structure 1308 includes one or more conductors such as Ni, Cu, Au, Mo, Ti, lacey carbon, and/or carbon nanotube meshes.

As previously described with respect to FIG. 5, the multilayered graphene grids as described herein may comprise one or more of graphene, graphyne, graphdiyne, a two-dimensional carbon allotrope, a two-dimensional semimetal material, and transition metal dichalcogenides.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An apparatus comprising:

a first grid configured to receive a flow of electrons in a vacuum device, wherein the first grid includes at least two substantially parallel layers of graphene each being one atom thick planar sheets, and wherein the vacuum device is configured with a set of device parameters;

wherein the first grid is receptive to a voltage source to produce a voltage in the first grid; and wherein the first grid is configured to transmit electrons in an energy pass band that is at least partially determined by the voltage and the set of device parameters.

2. The apparatus of claim 1 wherein the voltage is dynamically tunable, and wherein changing the voltage changes the energy pass band.

3. The apparatus of claim 1 wherein the set of device parameters and the voltage are selected to maximize the transmission of electrons through the first grid for the energy pass band.

4. The apparatus of claim 1 wherein the set of device parameters are at least partially selected according to a relative amount of inelastic scattering.

5. The apparatus of claim 4 wherein the set of device parameters are further selected to minimize the relative amount of inelastic scattering for a set of electron energies.

6. The apparatus of claim 1 wherein the set of device parameters includes a spacing between the at least two graphene layers that is at least partially determined by a spacer layer.

7. The apparatus of claim 6 wherein the spacer layer includes atoms.

8. The apparatus of claim 6 wherein the spacer layer includes molecules.

9. The apparatus of claim 1 wherein the set of device parameters includes a number of layers of graphene corresponding to the first grid, where the number of layers of graphene is greater than two.

10. The apparatus of claim 9 wherein the number of layers of graphene is further selected according to a mechanical strength of the first grid.

11. The apparatus of claim 1 wherein the set of device parameters includes a position of the first grid relative to a cathode and an anode.

12. The apparatus of claim 1 wherein the set of device parameters includes a voltage bias applied to at least one of a cathode, an anode, and the first grid.

13. The apparatus of claim 1 further comprising a second grid, and wherein the set of device parameters includes a position of the second grid relative to the first grid, a cathode, and an anode.

14. The apparatus of claim 12 wherein the set of device parameters includes a voltage bias applied to the second grid.

15. The apparatus of claim 1 wherein at least one of the at least two layers of graphene is doped.

16. The apparatus of claim 1 wherein the set of device parameters includes an incident angle defined by a direction of the flow of electrons and the first grid.

17. The apparatus of claim 1 wherein the first grid is arranged sufficiently close to a cathode to induce electron emission from the cathode when an electric potential is applied to the first grid in device operation.

18. The apparatus of claim 1 wherein the grid is characterized by an energy-dependent transmission probability spectrum, and wherein the set of device parameters is selected according to the energy dependent transmission probability spectrum.

19. An apparatus comprising:

a cathode and a graphene grid that are configured in a vacuum electronic device, wherein the graphene grid is configured to modulate a flow of electrons from the cathode in device operation and the graphene grid includes one or more layers that are one atom thick sheets;

wherein the cathode and the graphene grid are receptive to a voltage to produce an electric field between the cathode and the graphene grid; and wherein the graphene grid is deformable to change the electric field between the cathode and the graphene grid.

20. The apparatus of claim 19 wherein the deformation of the graphene grid is selected to change the electric field in a region proximate to the cathode to increase electron emission from the cathode.

21. The apparatus of claim 19 further comprising one or more additional grids arranged relative to the cathode and the graphene grid that are configured to modulate the flow of electrons, and wherein the graphene grid is deformable responsive to one or more forces from the one or more additional grids.

22. The apparatus of claim 19 wherein the graphene grid is pretensioned to adjust the amount of the deformation responsive to input.

23. The apparatus of claim 19 wherein the graphene grid is fabricated such that it is non-homogenous to facilitate bending of the grid in one or more regions.

24. The apparatus of claim 19 wherein the cathode further includes insulating supports configured to prohibit contact between the cathode and the graphene grid.

25. An apparatus comprising:

a cathode and a grid that are configured in a vacuum electronic device, wherein the grid is configured to modulate a flow of electrons from the cathode in device operation;

wherein the grid includes one or more layers of graphene that are one atom thick sheets on a support structure.

26. The apparatus of claim 25 wherein the support structure includes a layer of material patterned with holes.

27. The apparatus of claim 25 wherein the support structure includes at least one of a polymer, a silicon oxide, and silicon nitride.

28. The apparatus of claim 25 wherein the support structure is in contact with the cathode and the graphene grid, and wherein the support structure has a thickness that determines the separation between the cathode and the graphene grid.

29. The apparatus of claim 25 wherein the support structure includes a metal.

30. The apparatus of claim 29 wherein the metal includes at least one of Ni, Cu, Au, Al, Mo, and Ti.

31. The apparatus of claim 25 wherein the support structure includes an array of carbon nanotubes.

32. The apparatus of claim 25 wherein the support structure includes lacey carbon.

33. An apparatus comprising:

a cathode and a grid that are configured in a vacuum electronic device, wherein the grid is configured to modulate a flow of electrons from the cathode in device operation;

wherein the grid includes nanoribbons of graphene in one or more layers that are one atom thick sheets.

34. An apparatus comprising:

a cathode and a grid that are configured in a vacuum electronic device, wherein the grid is configured to modulate a flow of electrons from the cathode in device operation;

wherein the grid includes an array of carbon nanotubes and graphene in one or more layers that are one atom thick sheets.

* * * * *